US006475282B1

(12) United States Patent
Snodgrass et al.

(10) Patent No.: US 6,475,282 B1
(45) Date of Patent: Nov. 5, 2002

(54) INTELLIGENT CONTROL SYSTEM FOR EXTRUSION HEAD DISPENSEMENT

(75) Inventors: Ocie T. Snodgrass, Garland; Gregory M. Gibson, Dallas; Carl W. Newquist, Plano, all of TX (US)

(73) Assignee: FAStar, Ltd., Dallas, TX (US)

( * ) Notice: Subject to any disclaimer, the term of this patent is extended or adjusted under 35 U.S.C. 154(b) by 0 days.

(21) Appl. No.: 09/227,692

(22) Filed: Jan. 8, 1999

(51) Int. Cl.[7] ..... B05C 5/02

(52) U.S. Cl. ..... 118/663; 118/664; 118/665; 118/708; 118/712; 118/410

(58) Field of Search ..... 118/712, 713, 118/669, 683, 684, 685, 676, 679, 668, 410, 429, 663–665, 708, 300, 690; 425/141, 114, 113, 148; 427/8, 9, 10, 356

(56) References Cited

U.S. PATENT DOCUMENTS

| | | | | | |
|---|---|---|---|---|---|
| 4,898,117 | A | * | 2/1990 | Ledermann et al. | 118/690 |
| 5,505,777 | A | * | 4/1996 | Ciardella et al. | 118/663 |
| 5,516,429 | A | * | 5/1996 | Snodgrass et al. | 210/767 |
| 5,976,256 | A | * | 11/1999 | Kawano | 118/684 |

* cited by examiner

*Primary Examiner*—Laura Edwards
(74) *Attorney, Agent, or Firm*—Winstead Sechrest & Minick P.C.

(57) ABSTRACT

A control system for assisting in applying a uniform layer of liquid to a substrate. The control system monitors a fluid pump advantageously integrated directly with an extrusion head. The pump receives the material to be deposited from a remote reservoir and controls dispersion of fluid to the extrusion head. The pump dispense rate is controlled by hydraulic pressure selectively applied by a flow control motor. The control system ensures that a steady-state flow of the liquid is maintained while preventing transient perturbations during initial extrusion startup.

25 Claims, 13 Drawing Sheets

PUMP: DISPENSE RATE = 35 μl/SEC
ACCELERATION = 750 μl/SEC$^2$
STEADY STATE THICKNESS SHOULD BE 1.767 μm

SHUTTLE: SPEED = 12 mm/sec
ACCELERATION = 12 mm/sec$^2$

PUMP: DISPENSE RATE = 25 $\mu$l/SEC
ACCELERATION = 750 $\mu$l/SEC$^2$
STEADY STATE THICKNESS SHOULD BE 1.262 $\mu$m

SHUTTLE: SPEED = 12 mm/sec
ACCELERATION = 12 mm/sec$^2$

PUMP: DISPENSE RATE = 35 $\mu$l/SEC
ACCELERATION = 150 $\mu$l/SEC$^2$
STEADY STATE THICKNESS SHOULD BE 1.767 $\mu$m

SHUTTLE: SPEED = 12 mm/sec
ACCELERATION = 12 mm/sec$^2$

PUMP: DISPENSE RATE = 25 μl/SEC
ACCELERATION = 750 μl/SEC$^2$
STEADY STATE THICKNESS SHOULD BE 2.525 μm

SHUTTLE: SPEED = 6 mm/sec
ACCELERATION = 6 mm/sec$^2$

FIG. 11

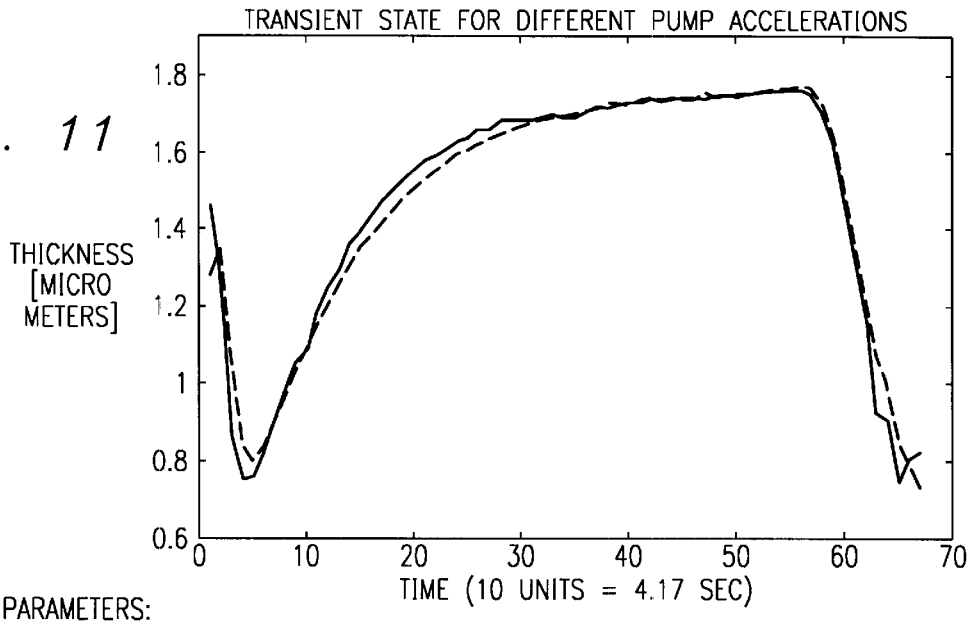

COMMON PARAMETERS:

PUMP: DISPENSE RATE = 35 μl/SEC

SHUTTLE: SPEED = 12 mm/sec
ACCELERATION = 12 mm/sec$^2$

DIFFERENCE:

PUMP: ACCELERATION (SOLID LINE) = 750 μl/SEC$^2$
ACCELERATION (DASHED LINE) = 150 μl/SEC$^2$
STEADY STATE THICKNESS FOR BOTH CURVES SHOULD BE 1.767 μm

FIG. 12

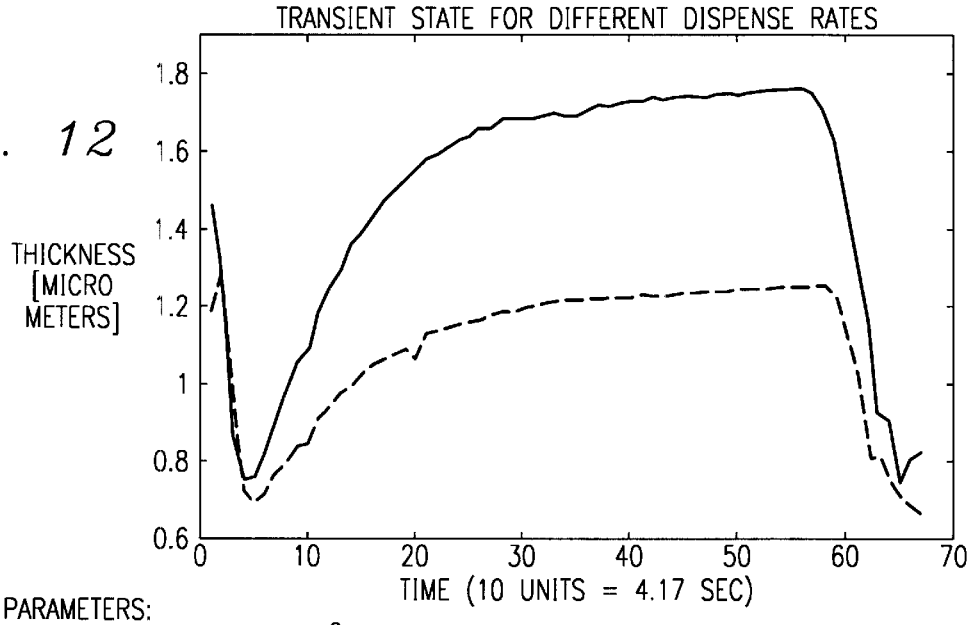

COMMON PARAMETERS:

PUMP: ACCELERATION = 750 μl/SEC$^2$

SHUTTLE: SPEED = 12 mm/sec
ACCELERATION = 12 mm/sec$^2$

DIFFERENCE:

PUMP: DISPENSE RATE (SOLID LINE) = 35 μl/SEC
DISPENSE RATE (DASHED LINE) = 25 μl/SEC
STEADY STATE THICKNESS FOR – SOLID LINE SHOULD BE 1.767 μm
– DASHED LINE SHOULD BE 1.262 μm

COMMON PARAMETERS:

PUMP: DISPENSE RATE = 25 $\mu$l/SEC

ACCELERATION = 750 $\mu$l/SEC$^2$

DIFFERENCE:

SHUTTLE: (SOLID LINE) SPEED = 6 mm/sec ACCELERATION = 6 mm/sec$^2$ (DASHED LINE) SPEED = 12mm/sec ACCELERATION = 12 mm/sec$^2$ STEADY STATE THICKNESS FOR THE – SOLID LINE SHOULD BE 2.525 $\mu$m – DASHED LINE SHOULD BE 1.262 $\mu$m

INTELLIGENT CONTROL SYSTEM FOR EXTRUSION HEAD DISPENSEMENT

RELATED APPLICATIONS

This application claims the benefit of U.S. Provisional Application Serial No. 60/070,985 filed Jan. 9$^{th}$, 1998, entitled "INTELLIGENT CONTROL SYSTEM FOR EXTRUSION HEAD DISPENSEMENT," and U.S. Provisional Application Serial No. 60/070,986 filed Jan. 9$^{th}$, 1998, entitled "METHOD AND APPARATUS FOR EXTRUSION COATING," the disclosures of which are incorporated herein by reference.

The present application is also related, and reference hereby made, to concurrently filed, co-pending, and commonly assigned patent applications: U.S. Pat. No. 6,092,937, issued Jul. 25, 2002, entitled "LINEAR DEVELOPER"; Ser. No. 09/227,667, entitled "MOVING HEAD, COATING APPARATUS AND METHOD"; Ser. No. 09/226,983, entitled "SYSTEM AND METHOD FOR INTERCHANGEABLY INTERFACING WET COMPONENTS WITH A COATING APPARATUS" now U.S. Pat. No. 6,387,184, issued May 14, 2002; Ser. No. 09/227,381, entitled "METHOD FOR CLEANING AND PRIMING AN EXTRUSION HEAD"; and Ser. No. 09/227,459, entitled "SYSTEM AND METHOD FOR ADJUSTING A WORKING DISTANCE TO CORRESPOND WITH THE WORK SURFACE", now U.S. Pat. No. 6,319,323, issued Nov. 20, 2001, the disclosures of which applications are incorporated herein by reference.

TECHNICAL FIELD

The present invention relates generally to methods and apparatus for depositing process coatings onto substrates, and more particularly, to a control system for improving the uniformity of such coatings especially at or near the leading edge of a substrate in a batch process.

BACKGROUND

Extrusion coating is a known method of directly depositing process coating onto substrates, wafers and similar objects (collectively "substrates") in the microelectronics, display technology and related industries, including coatings for polymer fuel cells. The substrates are transported linearly beneath an extrusion coating head and process fluids are precisely dispensed from a linear orifice in the extrusion head using a microprocessor-based electrohydraulic pumping system. Depending on the particular application, such process fluids include photoresist, polyimides, color filter materials and the like. Typically, the substrate is between 100–1500 mm square and the film thickness is between 1,500 angstroms and 25 microns. Such extrusion coating techniques are well suited for research and development activities as well as high volume production requirements.

Although known extrusion systems for this type provide significant advantages as compared to other liquid deposition techniques (such as spin coating), they often suffer from a similar problem—the inability of the coating head to establish a uniform coating at the leading edge of the substrate during certain applications. In these systems, there is a requirement that each substrate be leveled prior to the coating process and thus the coating deposition is started and stopped with each new substrate. With such "batch" processing, a coating "bead" must be re-formed between the extrusion head and each new substrate to thereby "wet" the surfaces. When this bead initially contacts the substrate, however, it may cause a "perturbation" for some measurable distance (e.g., 5 mm) from the leading edge of the substrate. Sometimes a leading edge anomaly of this type dictates that the substrate be rejected completely, thus increasing material and process costs and decreasing processing efficiency.

There have been attempts in the art to address the problem of establishing a uniform coating condition in a linear or so-called slot type extrusion coater, and systems of this type are illustrated in U.S. Pat. Nos. 4,938,994 and 5,183,508. In these patents, a controlled volumetric flow rate of the liquid is delivered to a liquid containing chamber within the extrusion head and then through the applicator slot to create what is said to be a uniform volumetric flow rate of liquid exiting from each point along the slot. A displacement piston associated with the extrusion head generates a fluid pulse to control the formation of a connecting bead of the liquid coating prior to, at the same time as, or after the sending of the controlled volumetric flow rate of the liquid. This technique purports to apply a layer of the liquid with a precisely-controlled volume per unit area of the liquid to the substrate. These machines in these patents also include a slot sealing unit that cleans the extrusion head slot between applications.

The techniques illustrated in these patents do not adequately address the problem of leading edge perturbations that may affect uniformity of the coating. Indeed, primarily these patents provide useful devices for cleaning the extrusion head itself between coatings, but such cleaning does not, in and of itself, solve this problem.

There remains a long-felt-need in the industry to overcome the problem of leading edge anomalies arising during the slot type coating of substrates in a batch process.

SUMMARY OF THE INVENTION

These and other objects, features and technical advantages are achieved by a system and method which comprises a control system for an extrusion head and pump mechanism for applying a uniform layer of liquid to a substrate. The extrusion head includes a liquid-containing chamber and a slot in communication with the chamber. A pump, integrally mounted to the extrusion head itself, such as is shown in the above referenced concurrently filed, co-pending patent application entitled "Moving Head, Coating Apparatus And Method," provides a steady-state fluid flow of liquid to the slot on the extrusion head. The integrally mounted pumping means enables precision control of flow conditions within the head in a manner that avoids transient perturbations during initial extrusion startup. Fluid is supplied to the pump from a fluid supply bay remotely located from the pump, or, if desired, integral with the system. The fluid supply bay includes a supply pump, a fluid reservoir and means for filtering the fluid. A substrate chuck movable between first and second positions moves the substrate relative to the extrusion head slot to provide a uniform coat of fluid to the substrate.

The control system consists of an adaptive type control unit, including a neural network system, or a programable controller. A pressure sensor within the head manifold will supply data to the control system to ensure no outgassing. A vision sensor on the substrate chuck as well as a vision sensor at the bead former on the extrusion head, preferably a CCD camera or a CCD monitoring the primary device, will provide data on the dispensation of the subject fluid to the control system. Based on these readings, the control system will control the fluid flowrate and the dispensing procedure to ensure that a smooth coating is produced. The process control system can also extend to monitoring the steady state flow from the fluid supply bay to the extrusion head as well as control the beading at the extrusion head by drawing back, if necessary, the subject fluid.

The foregoing has outlined some of the pertinent aspects of the present invention. These aspects should be construed to be merely illustrative of some of the more prominent features and applications of the invention. Many other beneficial results can be obtained by applying the disclosed invention in a different manner or modifying the invention. Accordingly, other aspects and a fuller understanding of the invention may be had by referring to the following detailed description of the preferred embodiment.

It will be appreciated by those who are skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawing, in which:

FIG. 11 is a graph of the transient state for different pump accelerations;

FIG. 12 is a graph of the transient state for different dispense rates;

DETAILED DESCRIPTION

Figure 1:
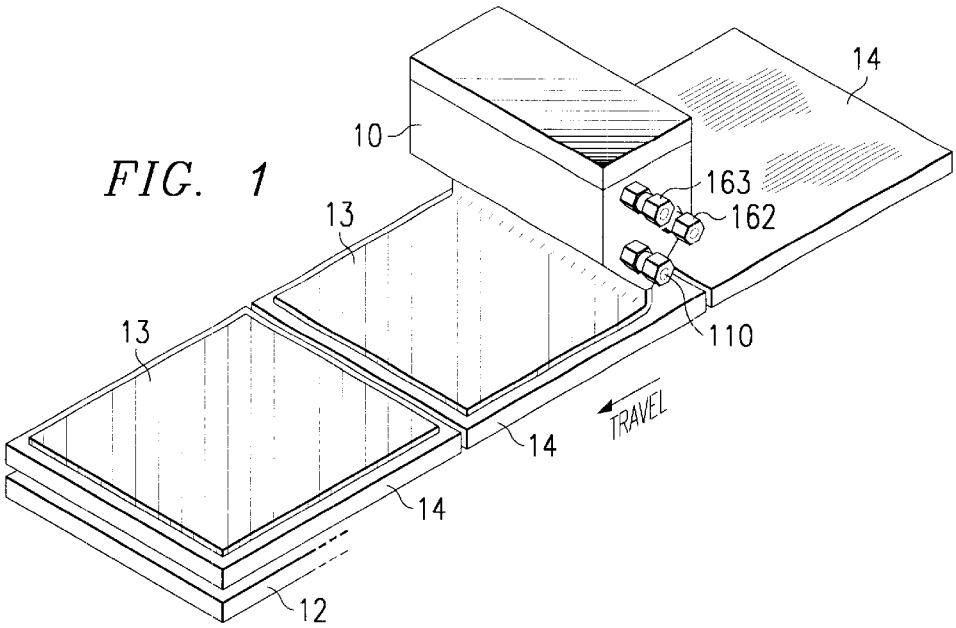
FIG. 1 is a perspective view of an extrusion coater having a linear or slot type extrusion head.

FIG. 1 is a perspective view of an extrusion coater having a linear or slot type extrusion head 10. In this view, chuck 12, preferably a vacuum chuck, supports a plurality of substrates 14, each of which is brought under extrusion head 10 and is thereby coated with a coating material 13 deposited from an elongated slot which can be changed to adjust the pattern of material deposited and/or the rate of deposit. Each substrate may be reciprocated under the extrusion head, which is fixed, or the extrusion head may be reciprocated relative to the substrate, which is fixed. The individual extrusions have leading and trailing edges where coating beads are formed. The dimensions of the bead are controlled and use a function of many factors, including how fast (or slow) the coating material can be started and stopped.

Figure 2:
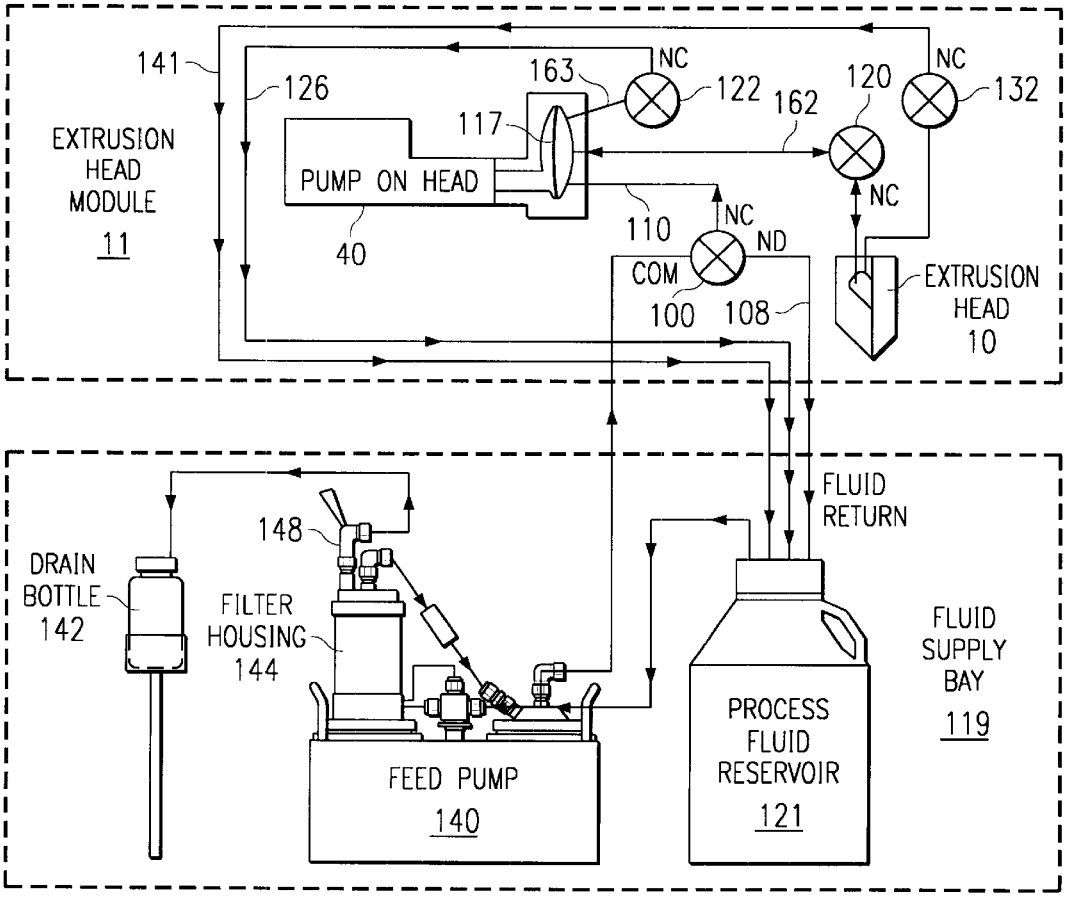
FIG. 2 is a plumbing diagram illustrating the flow of fluid through the extrusion mechanism.

Referring now to FIG. 2, process fluid for deposit on a substrate comes from fluid supply bay 119 which advantageously consists of process fluid reservoir 121, feed pump 140 and drain bottle 142. Process fluid to be deposited by the extrusion head is fed from process fluid reservoir 121 to feed pump 140 and is then filtered within filter housing 144. The filtered process fluid is then pumped by feed pump 140 to pump-on-head assembly 40 of extrusion head module 11 so that the fluid may be deposited on a substrate via head 10. Excess process fluid received by feed pump 140 is vented through feed pump filter vent 148 and stored in drain bottle 142 for reuse at a future date.

Fluid flow from feed pump 140 passes through a three-way recirculation valve 100 that routes the fluid flow either back to process fluid reservoir 121 in fluid supply bay 19 through conduit 108 or to the pump-on-head assembly 40 through conduit 110. The process fluid is driven through the pump-on-head assembly 40 by a pump drive means 112.

Figure 3:
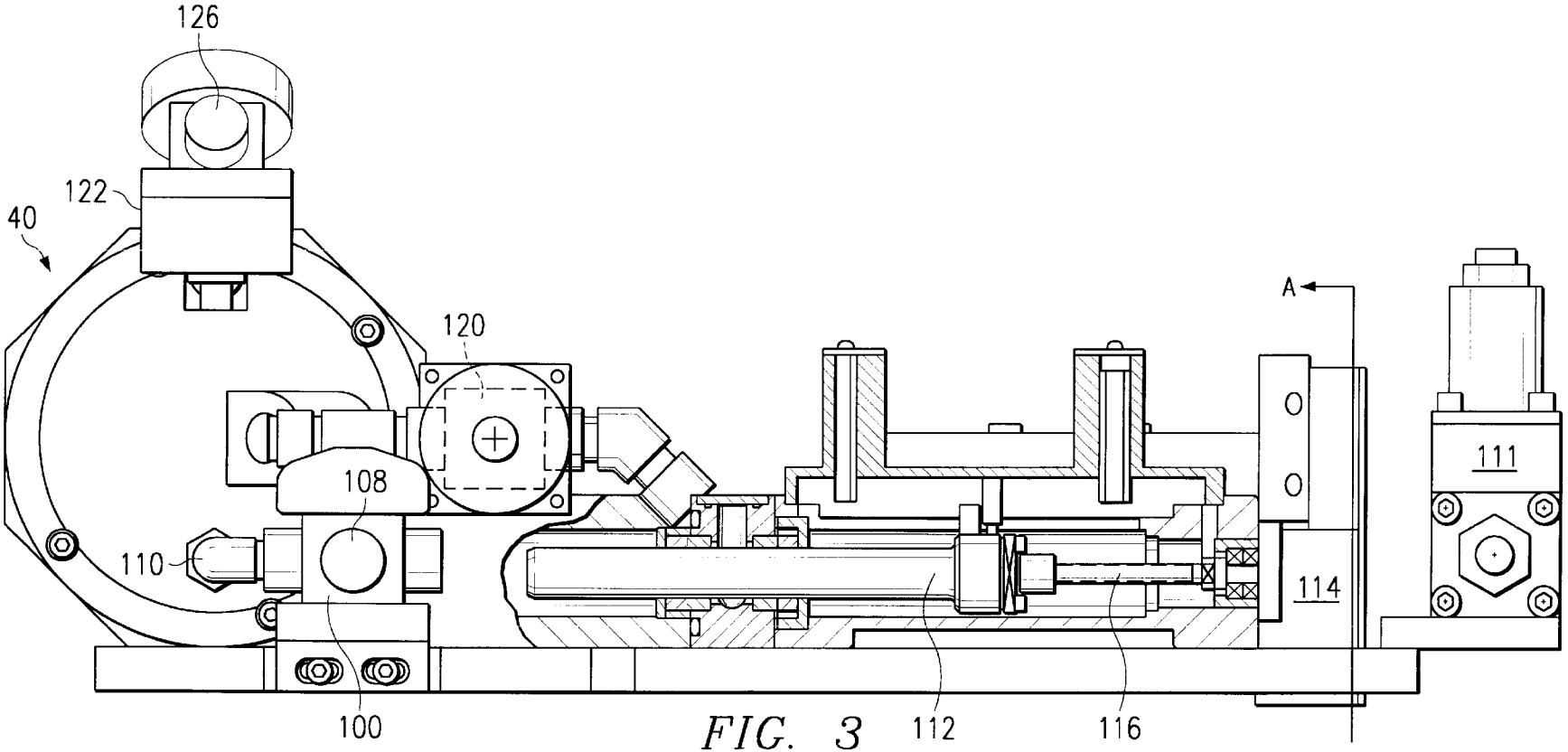
FIG. 3 is a partial cross-sectional view of the pump on head apparatus that is integrally connected to the extrusion head.

As shown in FIG. 3, pump drive 112 consists of a drive motor 111 coupled through transmission assembly 114 to a positively driven rod and seal arrangement 116. The rod and seal arrangement 116 is hydraulically coupled to an internal drive diaphragm 117 (shown in FIG. 2) within pump-on-head assembly 40. Drive motor 111 actuates drive rod 16 in precise and measurable movements to displace a desired amount of hydraulic fluid.

As shown in FIG. 2, the displaced hydraulic fluid drives diaphragm 117 to displace an amount of process fluid through pump-on-head assembly 40 to extrusion head 10 or back to fluid reservoir 121. The direction of process fluid flow depends on whether or not extrusion head 10 is in an active or inactive mode as determined by the settings of isolation valve 120 and vent valve 122. When head 10 is inactive, isolation valve 120 closes and vent valve 122 opens to direct flow of the process fluid back, via port 163, to process fluid reservoir 121 of fluid supply bay 119. During active operation, vent valve 122 closes and isolation valve 120 opens to direct flow of process fluid out of pump-on-head assembly 40 through port 162. Note that valves 120 and 122 could be a single valve with controlled outputs.

Figure 4:
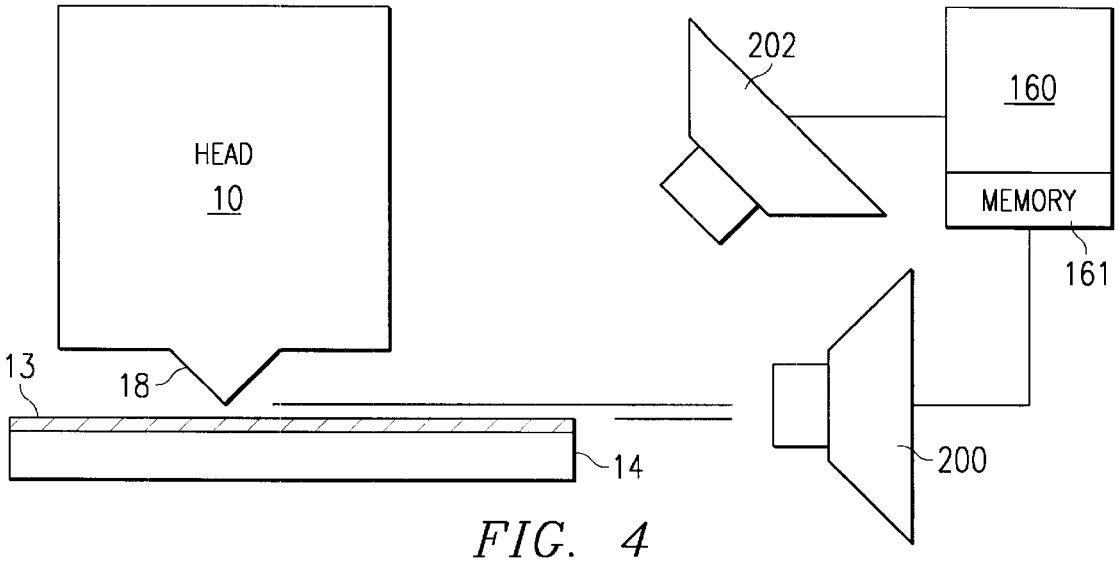
FIG. 4 is an illustration of the sensors used to monitor the beading at the dispenser.

Referring to FIG. 4, network 160 controls the steady-state fluid flow by monitoring the flow rate at ports 110 and 162 within extrusion head module 11. Port 110 measures the flow rate into pump-on-head assembly 40, while port 162 measures the flow rate from pump 40 to extrusion head 10. To ensure that the system has steady-state flow during the active and inactive periods, neural network system 160 will control the openings of recirculation valve 100, vent valve 122 and/or isolation valve 120 to control fluid flow anomalies.

Pump-on-head assembly 40 may also be configured to function as a vacuum pump to withdraw process fluid from extrusion head 10. This enables an extrusion to be stopped at a more precise point than would otherwise be possible. Extrusion vent valve 132 may also be used to vent extraneous process fluid from extrusion head 10 and limit excess flow. The vented process fluid returns to process fluid reservoir 121 within fluid supply bay 119 through conduit 141. Extrusion vent valve 132 may also be controlled by the neural network to correct fluid anomalies that reach the extrusion head.

As shown in FIG. 4, system 160, can also be used to control the beading at dispensing point 18 of head 10 before application of material 13 to substrate chuck 14. In the instances where a priming mechanism facilitates the establishment of a steady state flow condition from extrusion head 10 at the dispensing point 18, device 200, which can be a CCD camera or any other video camera, connected to system 160 informs system 160 to reiterate the priming process until the beading is satisfactory by either cleaning the extrusion head and re-priming or applying negative pressure to draw the coating back into the liquid chamber and then re-priming. The camera can provide video images of the surface for comparison with previously stored image parameters in memory 161 of system 160, which also traces and stores parameters, such as extrusion thickness, viscosity, speed of movement, etc.

A sensor on substrate chuck 14 (not shown) or a camera, such as a CCD or other imaging device 202, allows system 160 to calibrate either the movement of substrate chuck 14 or the movement of extrusion head 10 (depending on which mechanism is fixed) or of both if desired as the process material is applied to the substrate to ensure a smoother distribution on the substrate. Sensors 200 and 202 can be moved or positioned to scan across the coating width or along the length of the head, as desired.

Whenever it is desired to start coating with a certain material we have to know some characteristics of the material. The viscosity indicates what the distance between the lips of the die should be (shim), the solids content tells what the wet film thickness should be (given that the cured thickness is known). Also very important is the type of material. The discussion which follows is with respect to two types of fluid materials:

photoresist AZ 650, a material that is typical for photoresist and colored filter material;

polyimide PI 2611, a material that is typical for polyimide.

In addition to the characteristics of the fluid, there are certain tool-parameters that influence the coating. The dispense of the fluid is controlled by the dispense rate and acceleration of the pump and the motion of the substrate is controlled by the speed and acceleration of the shuttle (not shown) which controls the movement of the chuck.

The devices that are responsible for a) the dispense of the fluid and b) the motion of the substrate are controlled separately as discussed above. System 160 uses some equations (listed below) to determine starting parameters for the process. After some runs, system 160 checks the quality of the coating and adjusts the parameters, if necessary.

The equations mentioned above are:

$$\text{total dispensed volume} = \frac{(\text{length of substrate}) \times (\text{width of substrate}) \times (\text{desired thickness})}{(\text{solids content of fluid})} \quad (1)$$

$$\text{dispense rate} = \frac{(\text{substrate speed}) \times (\text{width of substrate}) \times (\text{desired thickness})}{(\text{solids content of fluid})} \quad (2)$$

$$\text{desired thickness} = (\text{wet film thickness}) \times (\text{solids content of fluid}) \quad (3)$$

After introducing the start values for the parameters, the coating process follows the following steps:

1) the substrate is fixed on the shuttle through the vacuum chuck;
2) a leveling device makes sure the substrate is level;
3) the shuttle brings the substrate in coating position (the beginning of the substrate is under the die lips);
4) the pump starts dispensing and after 0 to 3 seconds (dwell time) the substrate starts to move;
5) the substrate is coated;
6) after coating the substrate is put on a hot plate and the material is cured.

After the coating is finished, the thickness of the cured film along the substrate is measured at three different segments, namely: the leading edge, the steady state and the trailing edge.

The leading edge stretches from the beginning of the substrate for (typically) 1 to 3 inches. This is a transient state where the thickness is likely to not have the desired value, so it must be as short as possible. In the steady state, the coating has good uniformity and the thickness has the desired value. The trailing edge is again a transient state that stretches for 0.5 to 1 inch from the end of the substrate. Like for the leading edge, that distance should be as short as possible.

Figure 5:
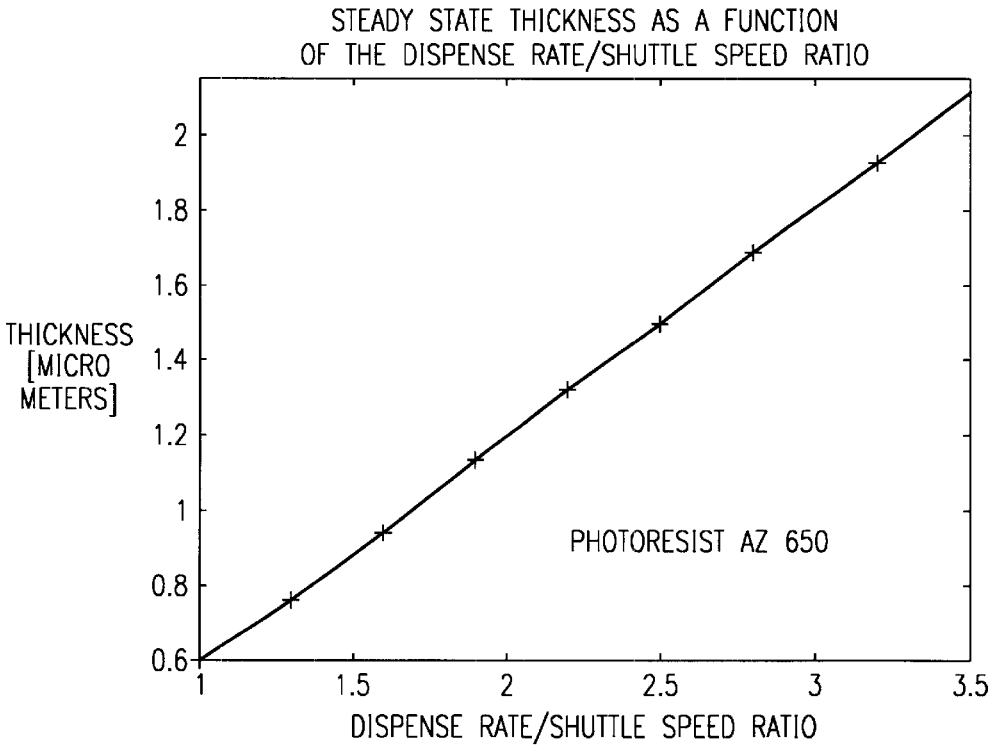
FIG. 5 is an illustration of the steady state thickness as a function of the dispense rate/shuttle speed ratio.
Figure 6:
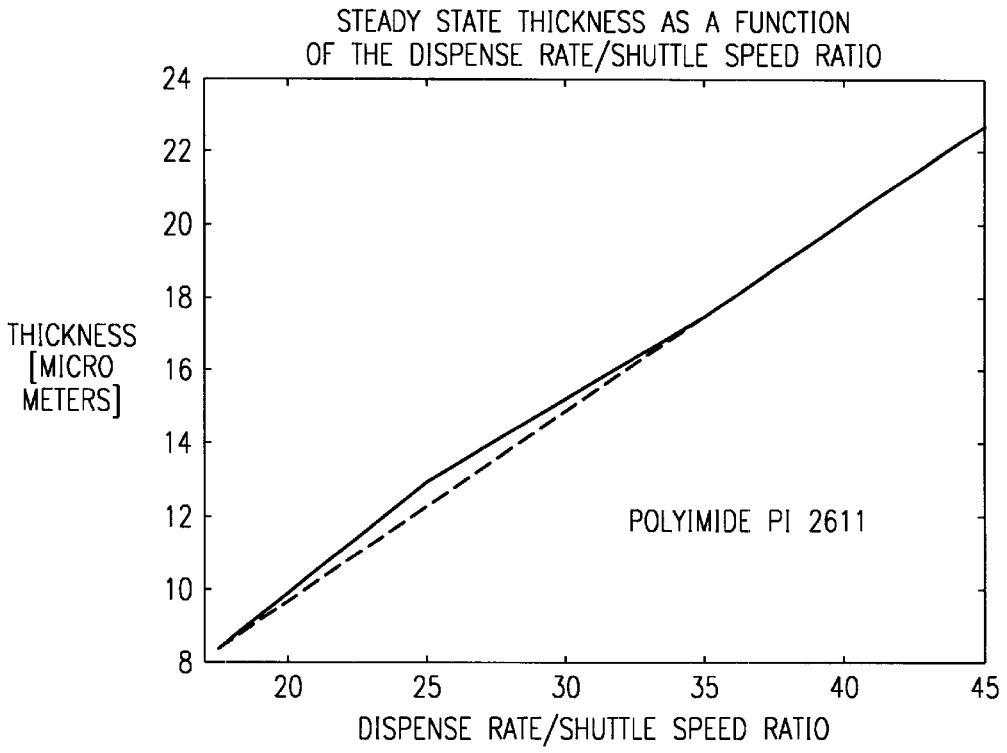
FIG. 6 is an illustration of the steady state thickness as a function of the dispense rate/shuttle speed ratio.

From FIG. 5 and FIG. 6 it is obvious that in the steady state the thickness can be described by the following equation:

$$\text{thickness} = \alpha \frac{(\text{dispenserate})}{(\text{shuttlespeed})} \quad (4)$$

where $\alpha$ is a constant coefficient that can be determined.

a) Photoresist AZ 650

Assuming the equation for the thickness in steady state is correct, we can compute $\alpha$ with the formula:

$$\alpha = \frac{\text{solids content}}{\text{width of substrate}} \quad (5)$$

Given the size of the substrate (length=340 mm, width=320 mm) and the solids content of the fluid (manufacturer's specification: 20.00%) we obtain a constant factor of $\alpha$=0.625 $m^{-1}$.

In the following experimentation, the head height was kept constant (100 $\mu$m) and in order to increase the dispense rate, we held the speed constant and increased the dispense rate. A more detailed listing of the parameter values used for the coating can be found in the table 1.

TABLE 1

Parameter values for steady state

| Dispense Rate [$\mu$l/sec] | Shuttle Speed [mm/sec] | Thickness [$\mu$m] | Uniformity [%] |
|---|---|---|---|
| 10 | 10 | 0.606 | 0.41 |
| 13 | " | 0.765 | 1.44 |
| 16 | " | 0.944 | 1.38 |
| 19 | " | 1.138 | 1.27 |
| 22 | " | 1.324 | 1.88 |
| 25 | " | 1.498 | 1.77 |
| 28 | " | 1.691 | 1.45 |
| 32 | " | 1.927 | 2.00 |
| 36 | " | 2.174 | 2.94 |

The coefficient a can be found by computing the slope in the graph of FIG. 5 $\alpha$=0.600 $m^{-1}$, which is very close to the value calculated before: $\alpha$=0.625 $m^{-1}$. The value which was determined experimentally leads to a solids content of the fluid of 19.2% which is close to the manufacturer's specification (20.00%).

b) Polyimide PI 2611

FIG. 6 shows the dependency of the thickness with respect to the dispense rate/shuttle speed—ratio (solid line) and the idealized linear dependency (dashed line). As can be seen, the experimental curve fits the theoretical model.

As in the case of photoresist, the shuttle speed was kept constant (4 mm/sec) and we varied the dispense rates (from 70 to 180 $\mu$l/sec) in order to obtain different coating thickness. The range of thickness covered by the experiments was from 8.4 $\mu$m to 22.73 $\mu$m.

However, there is an important difference between photoresist and polyimide. Whereas the head height was constant for all photoresist experiments, for polyimide the head height varied with the thickness. The thinner the coating, the smaller the gap between head and substrate. The head height was varied between 80 $\mu$m and 250 $\mu$m.

Typically, what is called transient state when we talk about coatings are the beginning and the ending of the coating: the leading and the trailing edges.

As the thickness in these regions varies from the desired thickness (which can be found in the steady state part) we want them to be as short as possible. There are several systems that influence the leading edge:

a) The speed of the shuttle that carries the substrate must be precisely controlled so its transient behavior is well known.

b) The second system is formed by extrusion head 10, pump on head (POH) 40 and pump motor 112. Usually, the acceleration of the motor is set to a very high value so that we can assume that the dispense rate reaches the desired value almost instantaneously (0.1–0.3 seconds).

c) The third system is formed by the bead. The bead is the deposition material that collects in front of the die head as the substrate is moved beneath it and is very delicate.

In order to describe the transient behavior of one of the systems accurately, we must be sure the other systems have reached steady state.

We designed some experiments that ran some coatings in a slightly different manner than they usually do. In order to be sure that the acceleration of the shuttle doesn't influence the part of the coating we wanted to explore, the dispense of the fluid started after the shuttle had reached steady state (i.e., after it had reached the desired speed). The sequence of the operations will be

. . .

the shuttle arrives in coating position;

the pump dispenses fluid for a few seconds on the priming roller;

the extrusion head moves in coating position;

the shuttle starts moving;

the shuttle reaches a constant (desired) speed;

the pump starts dispensing;

eventually the thickness of the coating reaches the steady state value;

the pump stops dispensing;

. . .

The relation between the shuttle speed and the distance the shuttle has run will be used to get a time axis for the following figures. Knowing that the shuttle speed is constant and dividing the substrate into length units, one unit (1 $\mu$)=5 mm, we get:

$$t = \frac{\text{length}}{\text{speed}} \quad (6)$$

A value for the shuttle speed that was used often in the experiments is 12 mm/sec. Thus, looking at the x-axis of the graph we can convert the values into time. Ten x-units (10 $\mu$=50 mm) will represent:

$$\Delta t = \frac{50 \text{ mm}}{12 \text{ mm/sec}} = 4.17 \text{ sec}$$

Each experiment was done twice to show repeatability.

From each substrate two sets of data (A and B) were collected from different parts of substrate binarily disposed from each other to show that the coating is consistent across the substrate.

Each Figure contains information about the pump and the shuttle for the A and B points.

Figure 7:
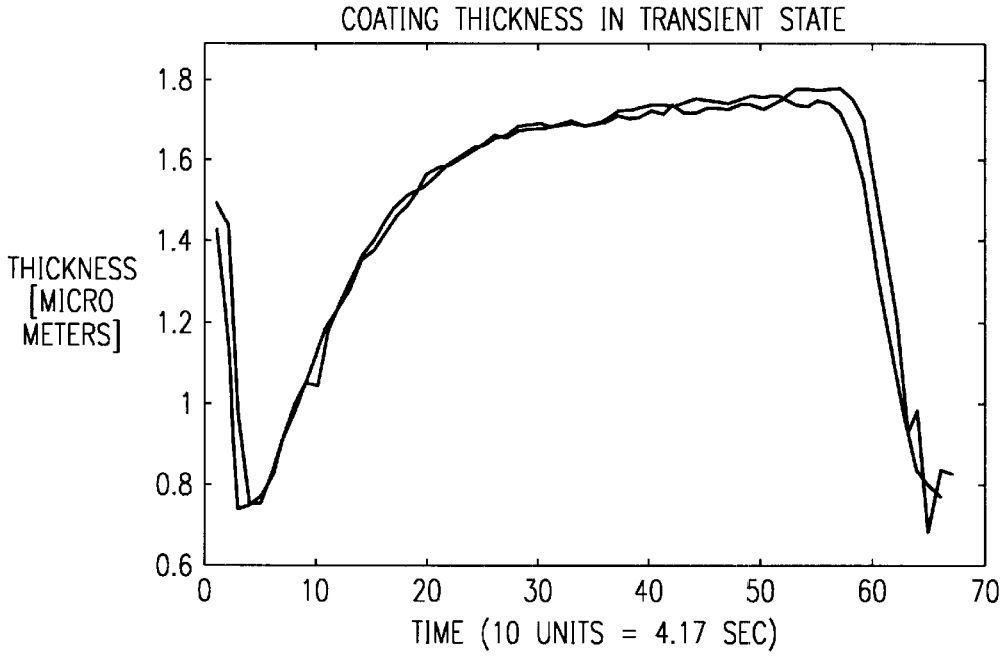
FIGS. 7, 8A, 8B, 9A, 9B, 10A, and 10B are graphs of the coating thickness in transient state.
Figure 8A:
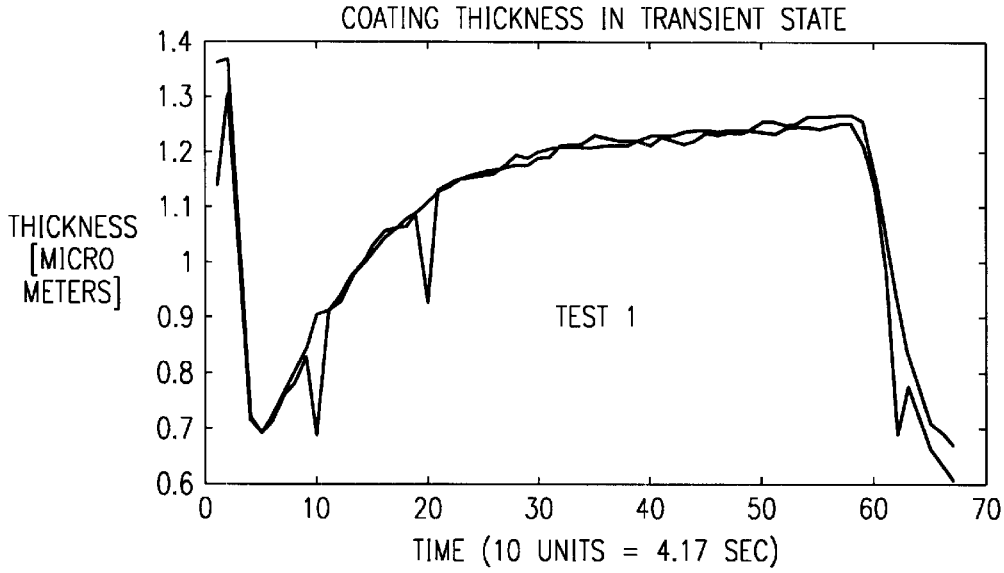
Figure 8B:
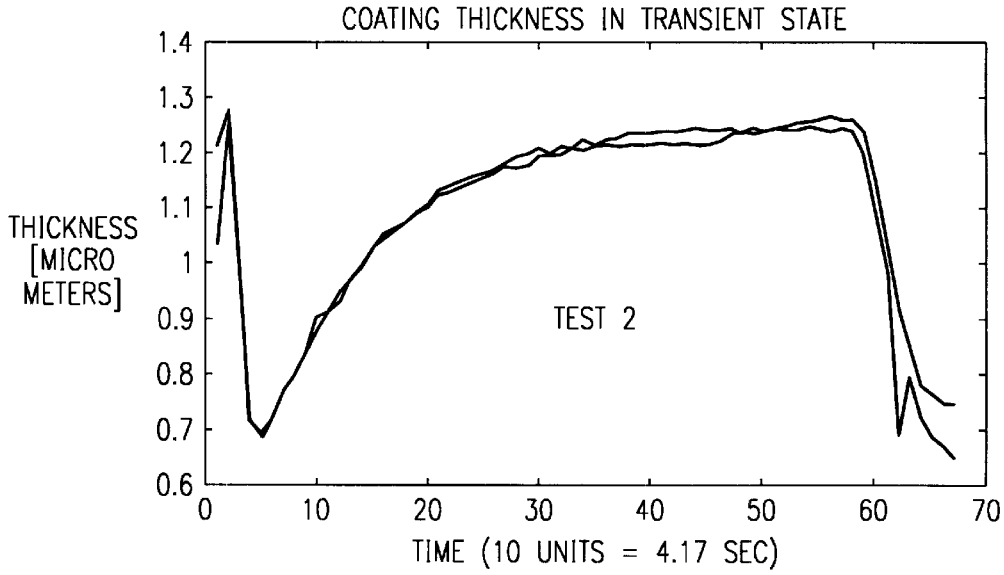
Figure 9A:
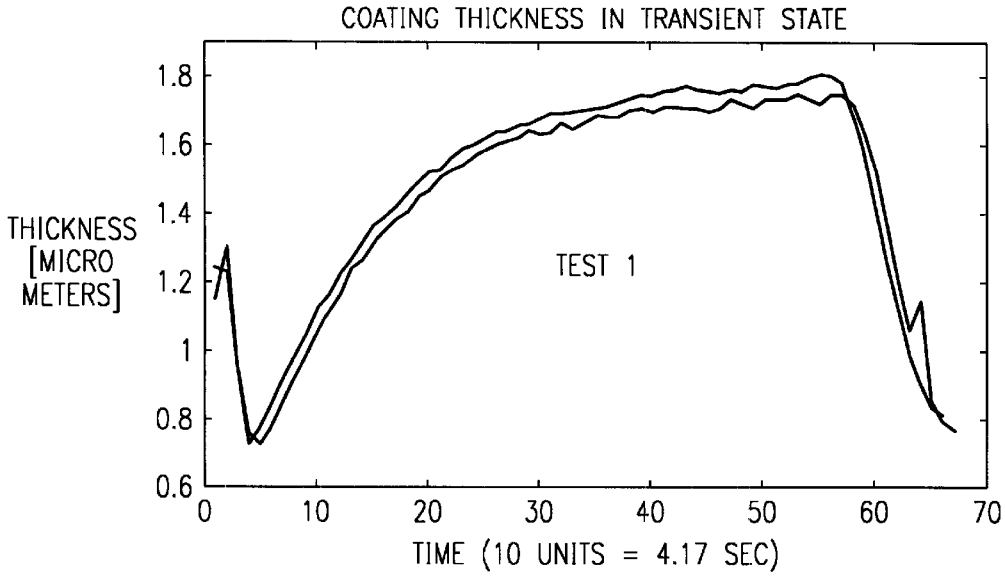
Figure 9B:
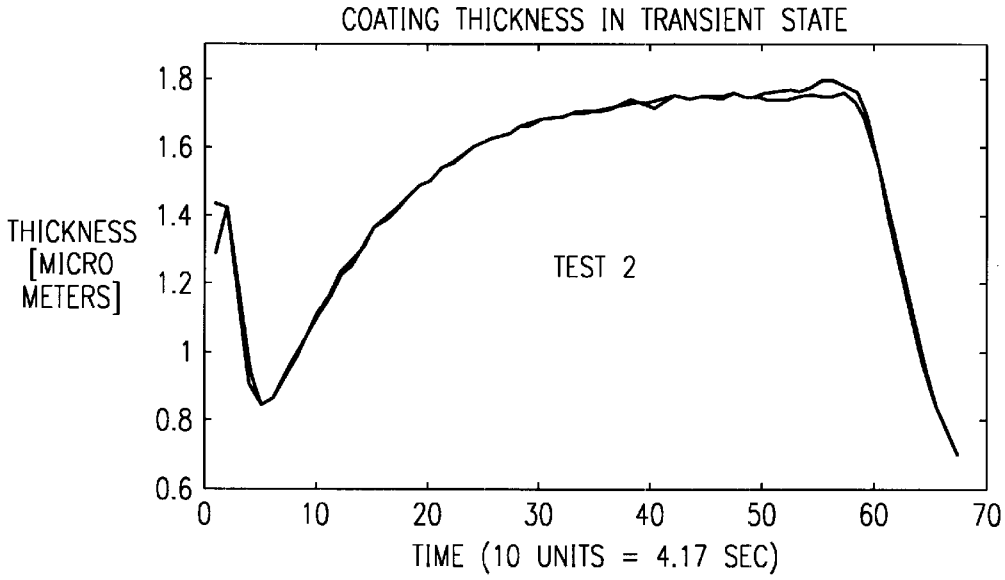
Figure 10A:
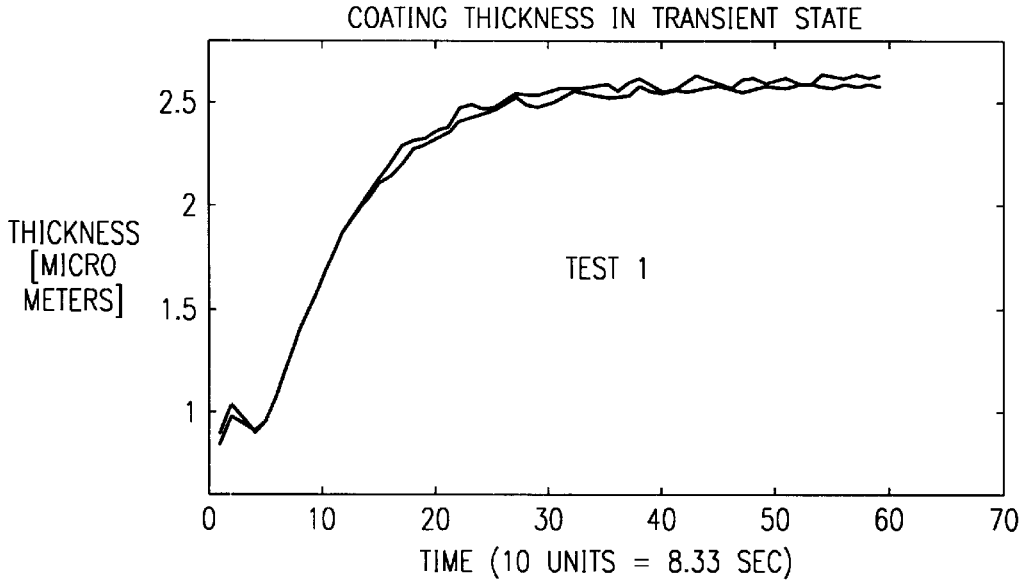
Figure 10B:
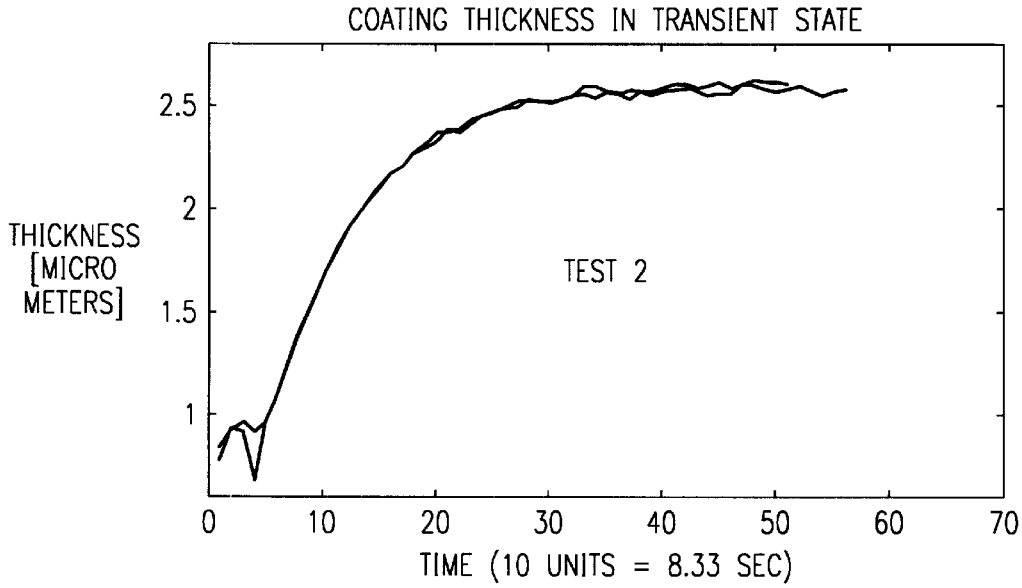

In the first set of seven graphs (FIGS. 7 to 9) we see the variation of the thickness for different parameter adjustments. Each graph shows two curves corresponding to the two sets of data collected from one substrate.

The y-axis represents the thickness in $\mu$m ($10^{-6}$ meter).

Ten units on the x-axis of the graph correspond to 4.17 sec or to 8.33 sec.

The fluid used for these experiments was photoresist AZ 650.

The shape of the curves drawn in the same Figure Number (i.e., same substrate) is pretty much the same.

This shows the thickness across the substrate is consistent.

The shapes of the curves drawn in the "B" Figure (i.e., FIG. 8B) (same coating parameters) are also very close.

This shows that the experiments are repeatable.

Figure 13:
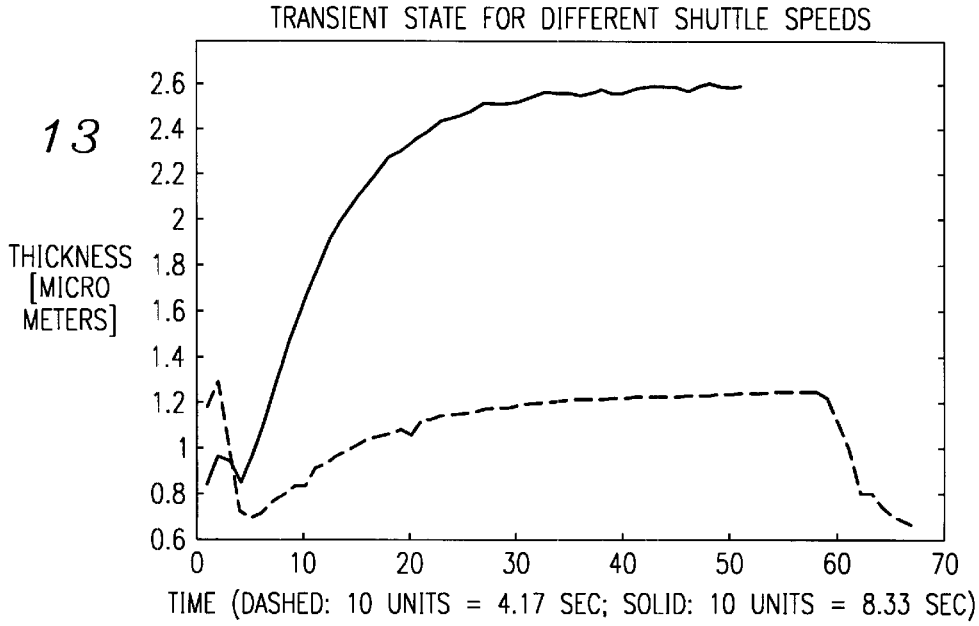
FIG. 13 is a graph of the transient state for different shuttle speeds

FIGS. 11–13 compare the evolution of the thickness under different conditions. One (maximum two) parameter is changed while the rest are held constant in order to see the effect upon the transient state.

An important result may be concluded from FIG. 11. The acceleration of the pump motor is not a major factor in determining the transient state of the system. Increasing the motor acceleration 5 times hardly made any difference.

Unlike the motor acceleration, the desired dispense rate influences the transient state. The bigger the desired dispense rate, the longer the system needs to get to steady state.

It will take a lot more to reach steady state if the shuttle moves slowly. However, now only the transients depending on just one parameter were considered. The situation may change if we considered the acceleration of the shuttle, too.

Note that the time scale for the solid line is twice as big as the one for the dashed line.

Figure 14:
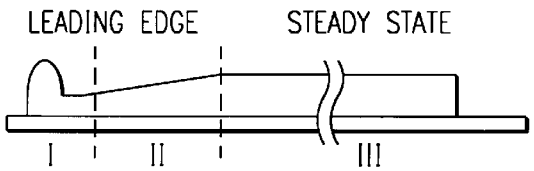
FIG. 14 (shown on sheet 2) is an illustration of a section along a coated substrate.

FIG. 14 shows a section along a coated substrate. We can distinguish three parts. The first two parts I and II form the leading edge.

(I). The first part is the thickest part of the coating. That is either because of the dispensing during the dwell time or, if there is no dwell time, because of the fluid that falls from the lips of the extrusion head on the substrate before actually dispensing.

(II). The second part is the thinnest of all. The shuttle is, in most of the cases in steady state and the bead hasn't yet reached the full volume. The shape of the coating is the one seen in the graphs above.

(III). Once the whole system reaches steady state the coating thickness is determined only by the dispense rate and the shuttle speed.

Figure 15:
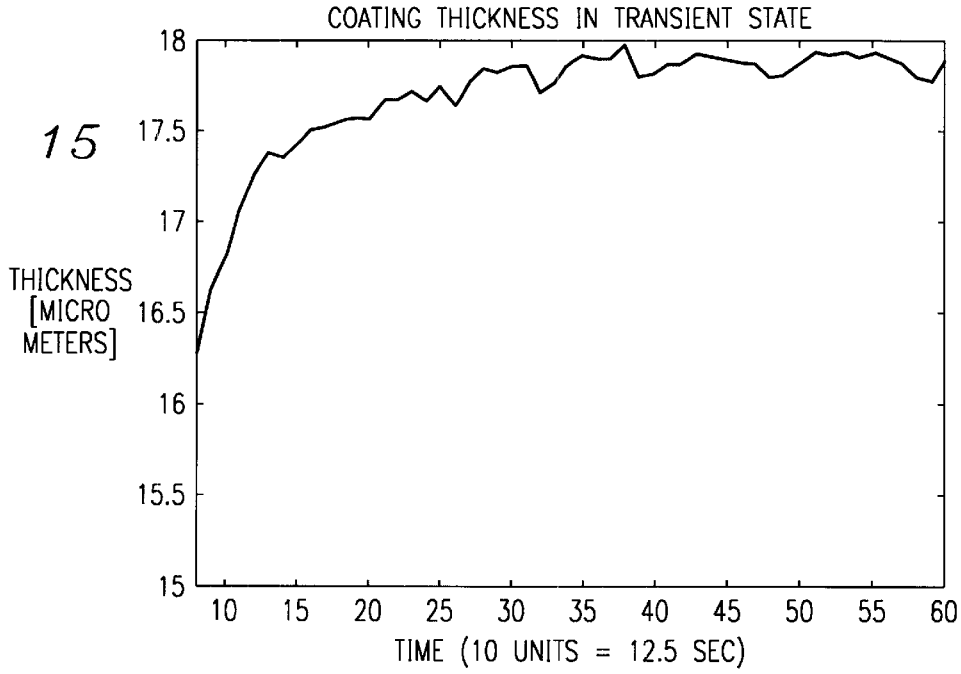
FIG. 15 is a graph of the coating thickness in transient state.

An attempt was made to also run the same experiments for polyimide material. Unfortunately, the transients for the fluid also used—PI 2611—could not be monitored. In these attempts, whenever the shuttle moved the dispense rate was too small, accordingly the coating bead broke and the same shape of the transient coating thickness as for photoresist could not be recorded. Another reason why this could not be done was because of the thick coating that is usually extruded on the substrate. Being so thick, the material doesn't cure fast and the material has enough time to flow and thus make the coating become more uniform. FIG. 15, is a curve that characterizes the transient sate of the polyimide. The problem is that the change in thickness is of $$\frac{1.5}{18} \times 100 = 8.33\%$$

This is too small when we look at the change in thickness for photoresist material, which is up to 70.00%.

The parameter settings are not specified because this graph is representative for all polyimide experiments that were run.

Based on the mass balance of the dispensed material, the deposited material and the material that goes into the bead, we try to approximate the change in bead volume during the extrusion process. Further, we will apply the equations on the experiments we have run and give some numerical values. All numerical values refer to the experiments with photoresist AZ 650.

The equations are derived according to the following basic assumption: when the pump displaces a volume V of material in a time period of c seconds, the volume V instantaneously begins to flow out of the die head and is out of the die head at the end of the c seconds time period (fluid is not compressible).

The following notations are used:

PS(t) is the pump speed at time t, but since it takes a very short time for the pump to reach the desired speed we will consider PS time invariant (i.e., PS(t)–PS*);

§(t) is the shuttle speed at time t. §* is the shuttle speed at steady state;

q is the shrinkage factor;

w is the width of the substrate;

T(t) is the cured thickness of material on the substrate at time t. The wet thickness at time t will thus be T(t)/q= $T_w(t)$. T* and $T_w$* are the steady state values of the cured, respectively wet thickness;

B(t) is the rate of change of the volume of the bead at time t.

Let e be a very small positive number and consider the time point t. The amount of volume moved by the pump during the time interval (t–e, t+e) is approximately equal to (2e)PS*. The volume of material deposited onto the substrate during the interval (t–e, t+e) is approximately equal to (2e)w$T_w$(t)§(t). The volume of material added to or subtracted from the bead during the time interval (t–e, t+e) is approximately equal to (2e)B(t).

We then have the fundamental relationship (mass balance equation):

$$(2e)wT_w(t)\S(t)+(2e)B(t)=(2e)PS^* \tag{7}$$

In the limit, as e goes to zero, we have:

$$wT_w(t)\S(t)+B(t)=PS^* \tag{8}$$

In steady state, B(t)=0, §(t)=§* and we have:

$$wT_w^*\S^*=PS^* \text{ or } T^*=(q/w)(PS^*/\S^*, \text{ which is the formula for the steady state} \tag{9}$$

When B(t) is not zero, we can solve for it:

$$B(t)=PS^*-wT_w(t)\S(t) \tag{10}$$

Note that we can solve for T(t):

$$T(t)=[qPS^*-qB(t)]/\S(t)/w$$

Hence if we know B(t) during the transient period, we can set PS* and §(t) to achieve the desired thickness T(t).

In the experiments we have run for the transient state both PS and § reached steady state (PS* and § respectively), so equation (1) becomes:

$$B(t)=PS^*-wT_w(t)\S^* \tag{11}$$

or $$B(t)=PS^*-w[T(t)/q]SS^* \tag{11$^1$}$$

Note that all the values on the right side of the equation are known. They are either constants (w, q) or parameters we can adjust (PS*, §*) or experimental results (T(t)).

If we integrate this equation from $t_1$ to $t_2$ we can calculate the change in bead volume during this time interval ($\Delta t=t_1=t_2$). The time point $t_1$ will correspond to the moment when the pump starts dispensing and $t_2$ will be chosen large in order to make sure the bead reached its full volume.

Figure 16:
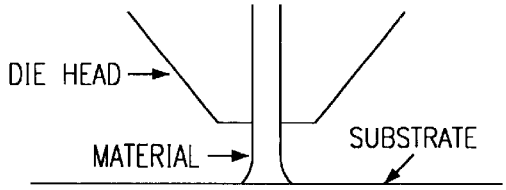
FIG. 16 is an illustration of the material as it starts to be extruded from the die head.

The extrusion process from the point of view of the bead formation will be described. The different states of the extrusion process will look like in the following:

When the shuttle is not moving, material is extruded in droplet from the die head as illustrated FIG. 16.

Figure 17:
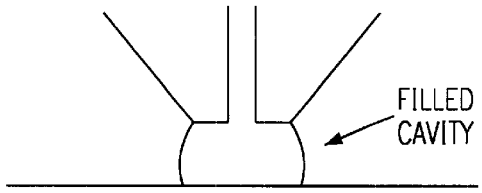
FIG. 17 is an illustration of the dispensed fluid at the end of the dwell time.

As material continues to flow out of the die head, it fills the "cavity" between the substrate and the die head. Surface tension prevents the material from flowing out of the cavity. Notice that the substrate hasn't started moving. The time difference between the point when the shuttle starts to move and the point when the pump starts dispensing is called the dwell time. The filled cavity is shown in FIG. 17.

Given the width of the substrate, the gap between the die lips and the substrate and the width of the lips together with the distance between them (shim) we can calculate the volume of the cavity:

$$V_1=(\text{gap height})\times(2(\text{lip width})+\text{shim})\times(\text{width of the substrate})$$

$$V_1=(100\ \mu\text{m})\times(400\ \mu\text{m})\times(320\ \text{mm})=13\ \mu\text{l}$$

If additional material is added, the filled cavity will "burst," and material will flow out in both directions. So the dwell time should only be long enough to fill the cavity.

Figure 18:
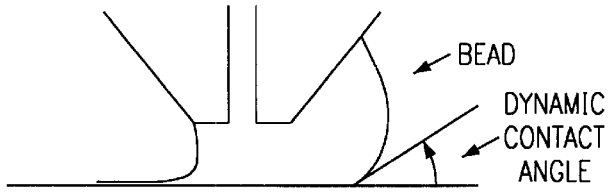
FIG. 18 is an illustration of the bead shape and dynamic contact angle.

As the shuttle starts moving to the left, a bead will begin to form on the right side of the die head. The bead will come way up on the die head so the volume of the bead will be quite large. This is illustrated in FIG. 18. Also as shown in FIG. 18, in steady state operation the bead will have a specific "dynamic contact angle," which is determined by the process conditions.

Based on this analysis, a possible procedure for coating is as follows:

set the dwell time so that the "cavity" is filled;

as soon as the cavity is filled, start the shuttle moving so that as soon as it reaches a steady state speed, enough material has been extruded to form the full bead (we need to know what the volume is for the full bead).

Figure 19:
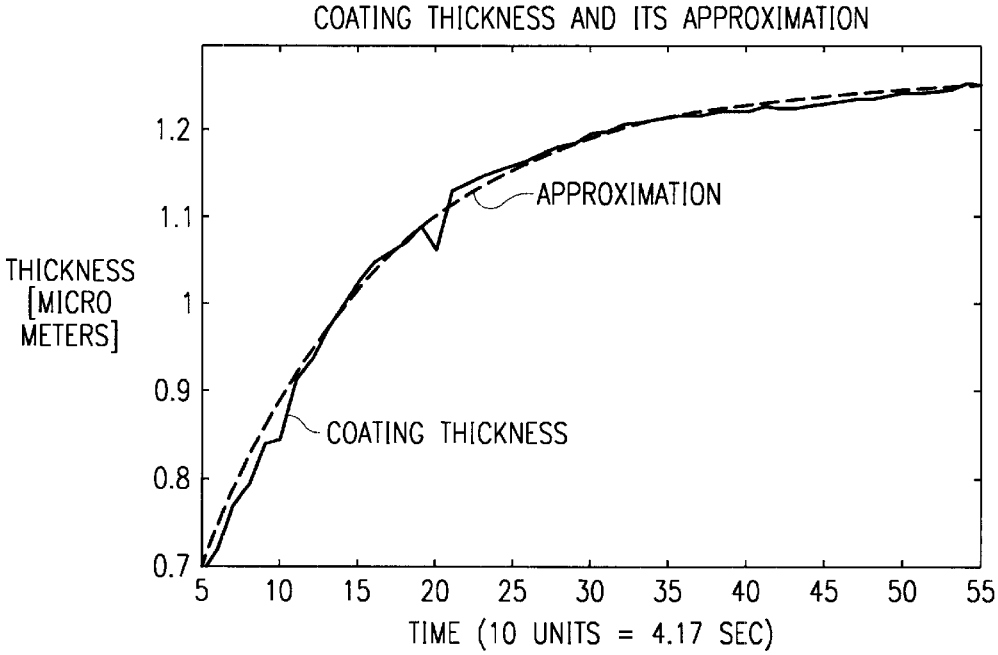
FIG. 19 is a graph of the coating thickness and its approximation
Figure 20A:
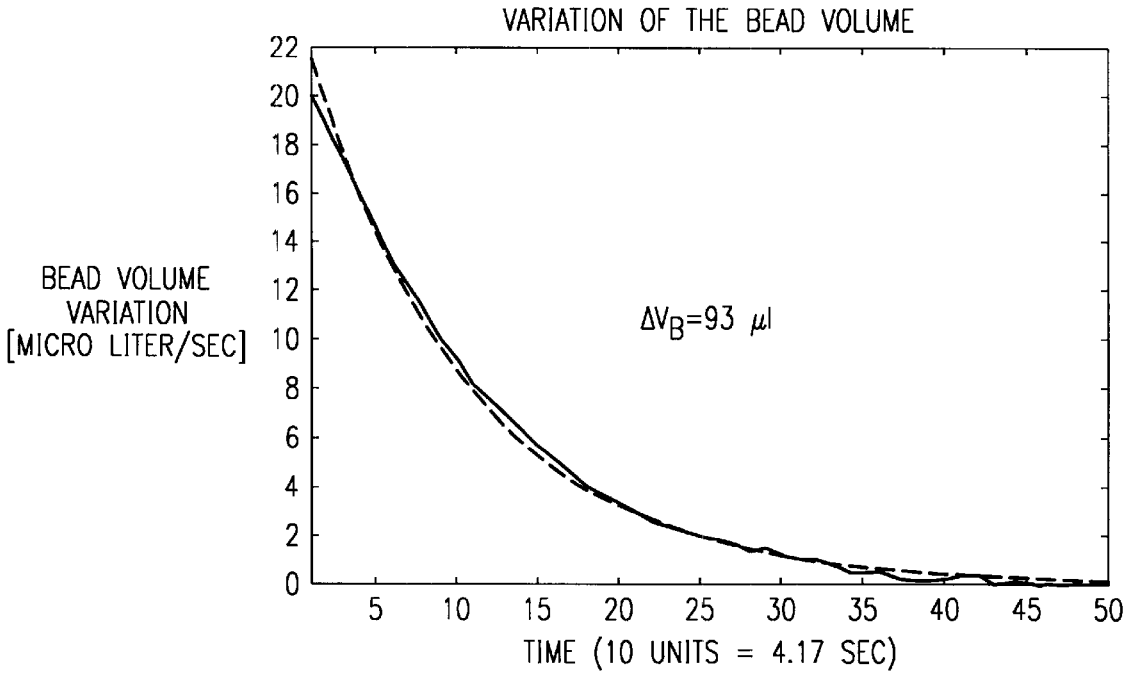
FIGS. 20A, 20B, 21A, 21B are graphs of the variation of the bead volume.
Figure 20B:
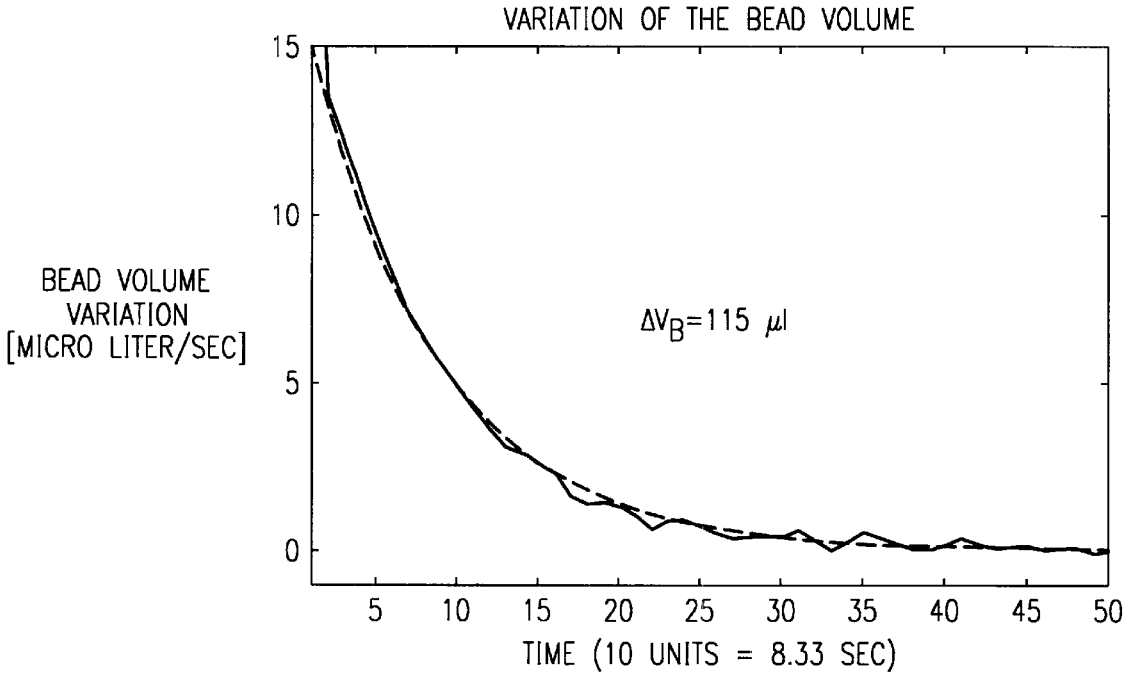
Figure 21A:
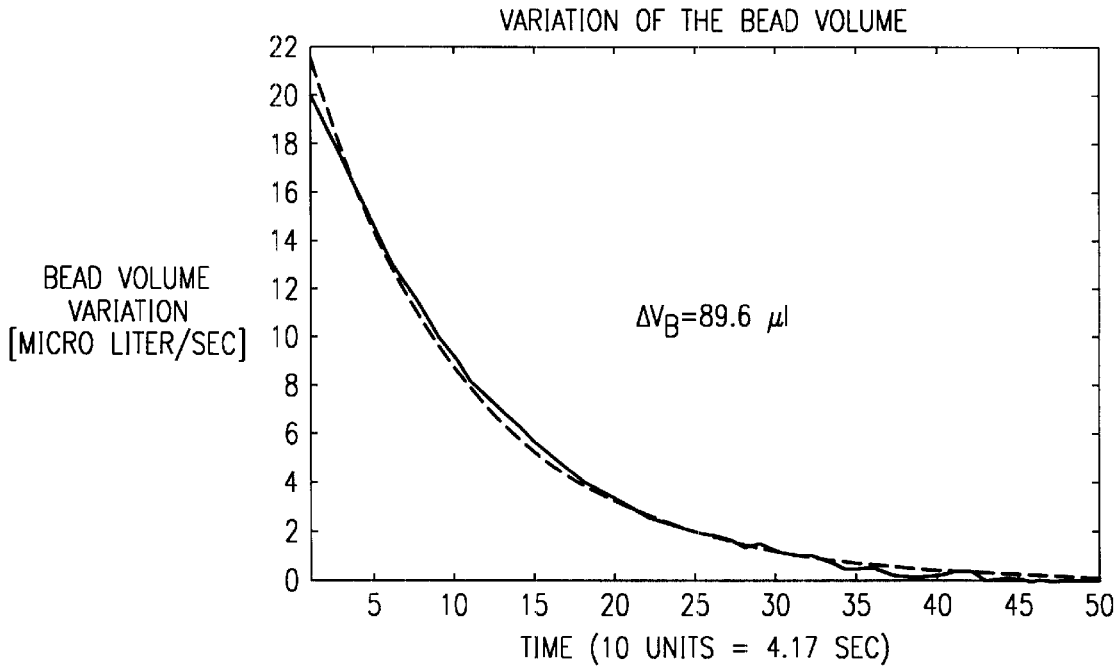
Figure 21B:
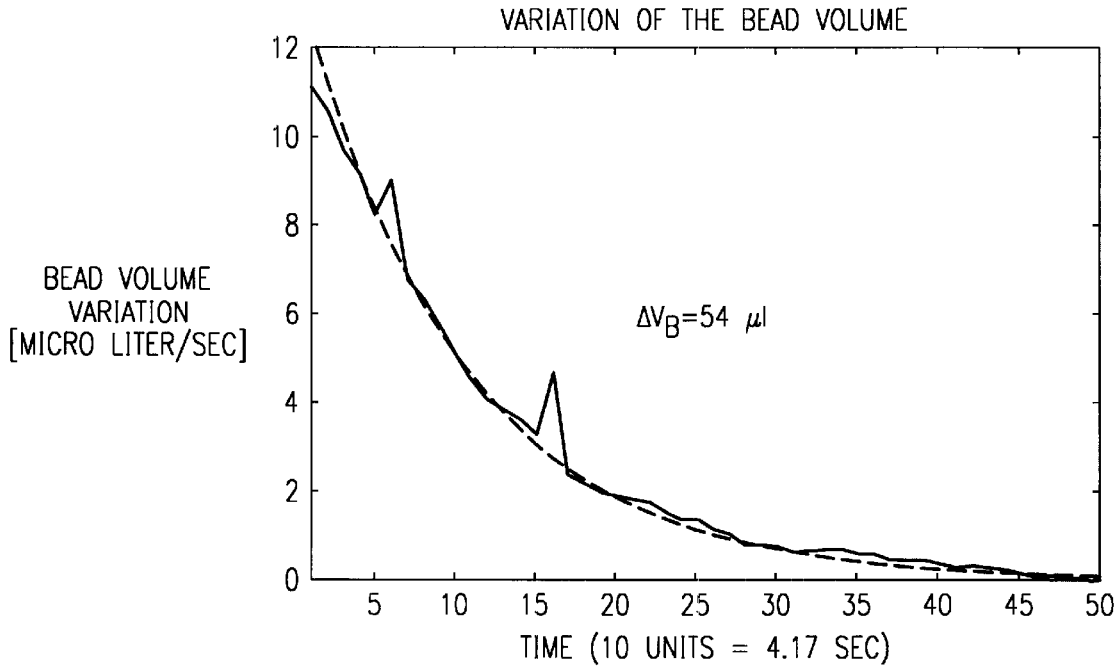

From the experiments we ran, we can't compute the whole bead volume because we don't know exactly how much fluid there was in the cavity when we started to dispense fluid, but we can be sure there were not more than 13 $\mu$l. In fact we can be sure there was much less than this amount. If we look at equation ($11^1$)

$$B(t)=PS^*-w[T(t)/q]SS^*$$

we see that we need an analytical expression for T(t) in order to integrate the equation. Exponential curves can approximate the derived curves, an example for such an approximation can be seen in FIG. 19.

The exponential curve ($700+562(1-e^{-t/\tau})$, $\tau=5.00$ sec) fits the experimental curve (dispense rate=25 $\mu$l/sec, shuttle speed=12 mm/sec) good enough so that the error made by integrating the exponential function (dashed line) instead of the experimental line (solid line) will be negligible.

FIGS. 20A, 20B, 21A and 21B represent equation ($11^1$) for the different parameter settings. Integrating equation ($11^1$) from $t^1$ (=moment when pump starts dispensing) till $t^2$ (=a very large number), we will get the change in bead volume during the transient state minus an initial value of the bead volume (which we believe is very small). The change in bead volume is clearly labeled in the figures.

As we can see the bead variation is not always the same. Of course we can assume measurement errors but it is clear that:

the bigger the dispense rate, the bigger the variation in bead volume;

the slower the shuttle speed the bigger the variation in bead volume.

Note from the figures that the variations in bead volume are much larger than the volume of the cavity we mentioned earlier.

Figure 22A:
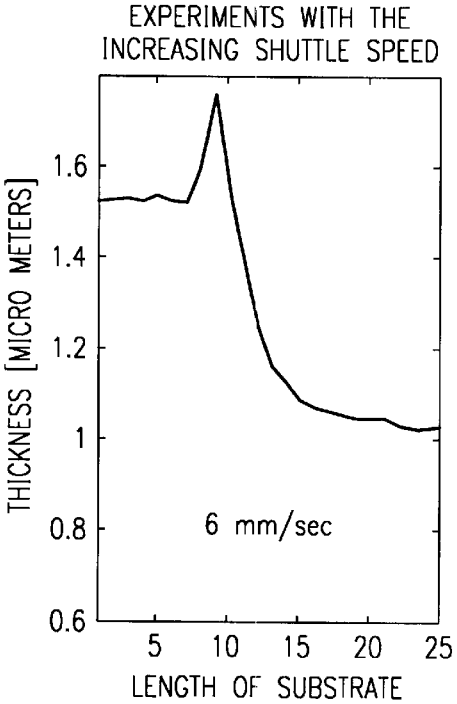
FIGS. 22A and 22B are graphs of the experiments with the segmented move of the shuttle.
Figure 22B:
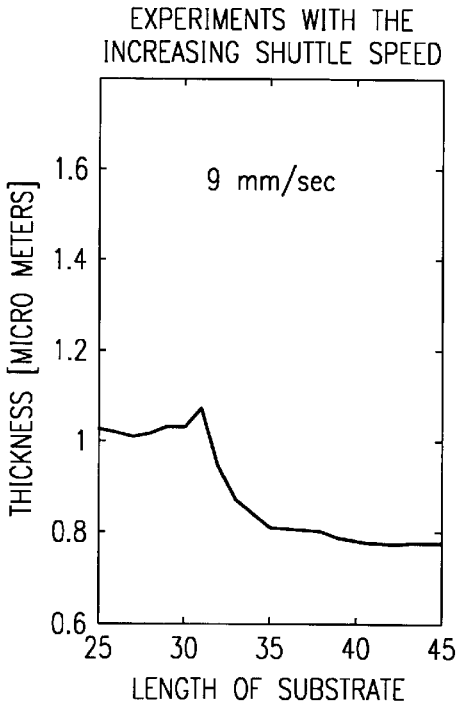

From FIGS. 22A and 22B we can also compute the change in bead volume for the different shuttle speeds. The graph where the speed increases was split in four parts and the two important observations are discussed in the following.

We first look at the transition from the steady state with a shuttle speed of 6 mm/sec (FIG. 22A) to the steady state with a shuttle speed of 9 mm/sec (FIG. 22B). The dispense rate is constant during this transition and equals 15 $\mu$lsec.

We calculate the volume of the dispensed fluid using the formula:

$$(\text{Dispensed Volume})=(\text{Dispense Rate})\times(\text{Dispense Time})$$

The Dispense Time is the sum of three terms: the time the shuttle moves with 6 mm/sec, the time the shuttle accelerates from 6 mm/sec to 9 mm/sec and the time the shuttle moves with 9 mm/sec. Hence, the dispensed volume will be 233.33 $\mu$l.

The volume of the deposited fluid is calculated by multiplying the area under the curve with the width of the substrate (0.32 m) and divided by the solids content of the fluid (20%). Hence the deposited volume will be 261.27 $\mu$l.

At first look it seems wrong to obtain such a result: we deposit more than we dispense. But it makes sense if we consider that the bead volume changes when the shuttle increases its speed (i.e., the bead volume gets smaller). Thus, the difference comes from the variation in bead volume:

$$\text{Volume}_{Bead}\ (6\ \text{mm/sec})-\text{Volume}_{Bead}\ (9\ \text{mm/sec})=261.27\ \mu\text{l}-233.33\ \mu\text{l}=27.94\ \mu\text{l}.$$

Figure 23A:
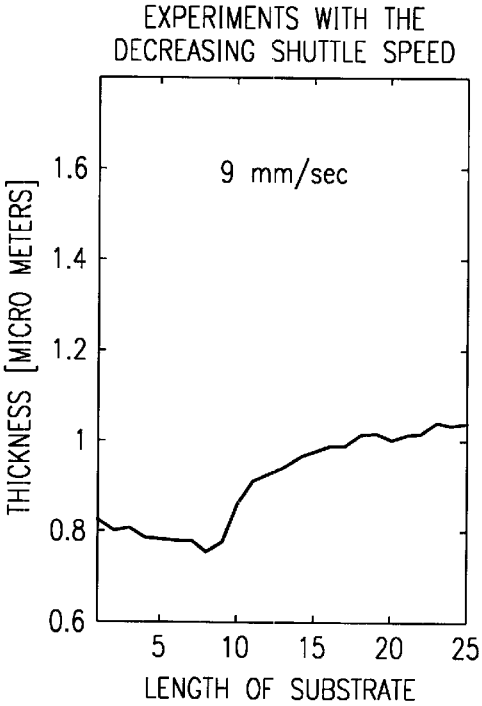
FIGS. 23A, and 23B are graphs of an experiment decreasing shuttle speed.
Figure 23B:
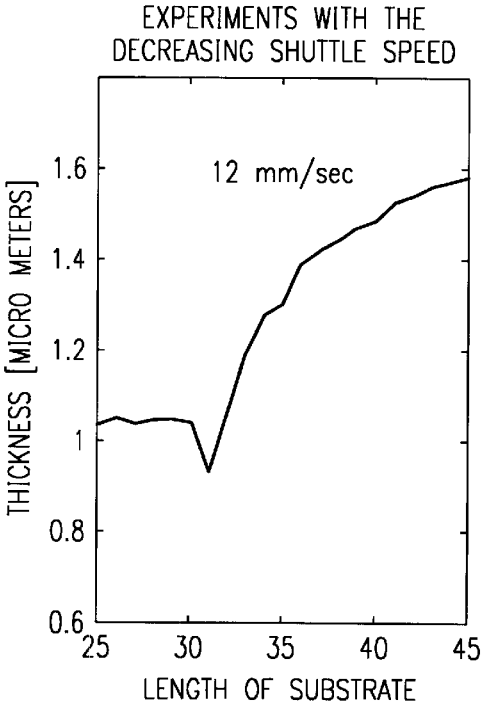

The same calculations were made for the transition from the steady state with a shuttle speed of 9 mm/sec (FIG. 23A) to the steady state with a shuttle speed of 12 mm/sec (FIG. 23B). The dispense rate is constant and equals 15 $\mu$l/sec.

The dispensed volume is 138.69 $\mu$l while the deposited volume is 149.79 $\mu$l.

Again we deposit more than we dispense. The difference comes from the variation in bead volume:

$$\text{Volume}_{Bead}\ (9\ \text{mm/sec})-\text{Volume}_{Bead}\ (12\ \text{mm/sec})=149.79\ \mu\text{l}-138.69\ \mu\text{l}=11.10\ \mu\text{l}.$$

Note that the variation is smaller than in the first case (29.94 $\mu$l) because the bead volume itself is smaller when the shuttle speed is greater.

The total variation of the bead between the steady states with shuttle speeds of 6 mm/sec and 12 mm/sec is:

$$\text{Volume}_{Bead}\ (6\ \text{mm/sec})-\text{Volume}_{Bead}\ (12\ \text{mm/sec})=11.10\ \mu\text{l}-27.94\ \mu\text{l}=39.04\ \mu\text{l}.$$

The same experiments were done also for the case that the shuttle speed decreased. The volume of the deposited material and the dispensed volume were calculated the same way as above.

First we looked at the transition from the steady state with a shuttle speed of 12 mm/sec to the steady state with a shuttle speed of 9 mm/sec. The dispense rate is constant and equals 15 $\mu$l/sec. The dispensed volume is 191.66 $\mu$l while the deposited volume is 185.87 $\mu$l.

This time we dispense more than we deposit. Again this makes sense: the bead volume increases as the shuttle moves slower. Thus not all the dispensed fluid goes to the substrate, some of it has to go to form the larger bead.

$$\text{Volume}_{Bead}\ (9\ \text{mm/sec})-\text{Volume}_{Bead}\ (12\ \text{mm/sec})=191.66\ \mu\text{l}-185.87\ \mu\text{l}=5.79\ \mu\text{l}.$$

When we go from the steady state with a shuttle speed of 9 mm/sec to the steady state with a shuttle speed of 6 mm/sec we have a dispensed volume of 234.79 $\mu$l and deposited volume of 218.47 $\mu$l. This is consistent with the results we have obtained so far.

The variation in bead volume is:

$$\text{Volume}_{Bead}\ (6\ \text{mm/sec}) - \text{Volume}_{Bead}\ (9\ \text{mm/sec}) = 234.79\ \mu l - 218.47\ \mu l = 16.32\ \mu l.$$

and the total variation of the bead between the steady states with shuttle speeds of 6 mm/sec and 12 mm/sec, in the case we decrease the shuttle speed, is:

$$\text{Volume}_{Bead}\ (6\ \text{mm/sec}) - \text{Volume}_{Bead}\ (12\ \text{mm/sec}) = 5.79\ \mu l - 16.32\ \mu l = 12.11\ \mu l.$$

Note that this value is not very close to the one obtained for the same transition between the steady states with a shuttle speed of 6 mm/sec and with a shuttle speed of 12 mm/sec but in the case when the shuttle speed was increased (39.04 $\mu$l).

An explanation for this may be that the steady state volume of the bead is not only a function of the steady state values of the shuttle speed and dispense rate but also of the transients of that parameters (i. e., the acceleration of the shuttle). Such a dependency complicates the process and must be considered if the variation in results is important.

Although the present invention and its advantages have been described in detail, it should be understood that various changes, substitutions and alterations can be made herein without departing from the spirit and scope of the invention as defined by the appended claims.

What is claimed is:

1. A system for extruding material uniformly onto a surface, where the extrusion process is subject to starting and stopping, the system comprising:

a pump head for accepting the extrusion material for delivery to the surface;

means for selectively directing controlled amounts of accepted material from said pump head to the surface and amounts of said accepted material away from said surface;

said selective directing means functionally connected to said pump head; and means for monitoring the amount of extrusion material directed to the surface and monitoring the amount of extrusion material directed away from the surface; said monitoring means functionally connected to said means for selectively directing.

2. The system of claim 1 where said selectively directing means includes controllably applying pressure to said pump head.

3. The system of claim 2 wherein said controlled pressure is applied by hydraulic fluid controllably driven.

4. The system of claim 1 wherein said monitoring means includes means for responding to the material applied to the surface after said application.

5. The system of claim 1 wherein said pump head is selectively operable for withdrawing amounts of extruded material from said surface.

6. The system of claim 5 wherein said withdrawn amounts are controlled, at least in part, by said monitoring means.

7. The system set forth in claim 1 wherein said monitoring means includes a network for tracking and storing selected parameters pertaining to said surface extrusion, some of said parameters pertaining to the desired extruded thickness, to the speed of surface movement and to the extruded material.

8. The system set forth in claim 7 wherein said network controls said selectively directing means in accordance with said parameters.

9. The system of claim 1 wherein said monitoring means includes means for video monitoring said extruded material on said surface.

10. The system of claim 1 wherein said monitoring means is operative prior to the enabling of said selectively directing means.

11. The system of claim 1 where said selectively directing means is controlled, at least in part, by said monitoring means.

12. A head system for coating a flat surface, said head system including:

an opening for depositing coating material on said flat surface as said flat surface moves relative to said opening;

a control for providing selective amounts of said coating material to said opening; and a monitor for observing the surface upon which said coating is being deposited;

wherein said control includes the storage of parameters which are to be compared to parameters monitored by said monitor.

13. The system of claim 12 wherein said control includes the removal of said coating material deposited on said surface.

14. The system of claim 12 wherein said opening is attached to a pump head and wherein amounts of said coating material are delivered to said pump head independent of the amount of said coating material to be delivered to said opening.

15. The system of claim 14 wherein said pump head includes at least one coating material flow control device.

16. The system of claim 15 wherein said at least one flow control device selectively sends certain amounts of said delivered coating material to said opening and certain amounts of said coating material away from said opening.

17. The system of claim 12 wherein said amounts of said coating material which are delivered to said opening and delivered away from said opening are monitored by said monitor.

18. The system of claim 12 wherein said monitor is positionable with respect to said surface.

19. The system of claim 12 wherein said monitor also observes certain parameters before and during the providing of selective amount of coating to said opening and wherein said monitor operates to modify said selective amounts based upon said observed parameters.

20. The system of claim 12 where said coating material is deposited relatively uniformly across said flat surface.

21. A head system for coating a flat surface, said head system including:

an opening for depositing coating material on said flat surface as said flat surface moves relative to said opening;

a control for providing selective amounts of said coating material to said opening; and a monitor for observing the surface upon which said coating is being deposited;

wherein said coating material is deposited in discontinuous batches and wherein said monitor is operative to provide signals to said control to effect said selective amounts of coating.

22. The system of claim 21 wherein said coating has a series of leading edges of said discontinuities and wherein said monitor is operative to selectively control the flow of said coating material at said leading edges.

23. The system of claim 22 wherein said monitor is operative for measuring certain parameters and for changing said control signals based upon said measured parameters.

24. The system of claim 23 wherein some of said measured parameters are present prior to the beginning of said leading edges.

25. The system of claim 23 wherein said parameters are observed by imaging techniques.

* * * * *